US009687096B2

(12) United States Patent
Woestenborghs

(10) Patent No.: US 9,687,096 B2
(45) Date of Patent: Jun. 27, 2017

(54) CONTAINER

(71) Applicant: deSter B.V.B.A., Hoogstraten (BE)

(72) Inventor: Francis Woestenborghs, Beerse (BE)

(73) Assignee: deSter B.V.B.A., Hoogstraten (BE)

( * ) Notice: Subject to any disclaimer, the term of this patent is extended or adjusted under 35 U.S.C. 154(b) by 0 days.

(21) Appl. No.: 14/574,078

(22) Filed: Dec. 17, 2014

(65) Prior Publication Data

US 2015/0265082 A1 Sep. 24, 2015

(30) Foreign Application Priority Data

Dec. 20, 2013 (DE) ..... 20 2013 105 890 U

(51) Int. Cl.
*A47G 23/02* (2006.01)
*B65D 71/70* (2006.01)
*B65D 5/52* (2006.01)

(52) U.S. Cl.
CPC ..... *A47G 23/0208* (2013.01); *B65D 5/5253* (2013.01); *B65D 71/70* (2013.01)

(58) Field of Classification Search
CPC ..... B65D 5/50; B65D 71/70; B65D 5/5253; A47G 23/0208
USPC ... 206/763, 45.3, 485, 780, 45.24, 756, 762, 206/485.1, 7.1, 736, 443, 426
See application file for complete search history.

(56) References Cited

U.S. PATENT DOCUMENTS 3,302,776 A * 2/1967 Sparks ..... B65D 5/504 206/485
4,450,965 A * 5/1984 Paillet ..... B65D 85/42 206/443
5,188,223 A * 2/1993 Brose ..... B65D 5/5253 206/45.24
5,361,907 A * 11/1994 Mohrhauser ..... B65D 5/504 206/443

(Continued)

FOREIGN PATENT DOCUMENTS

BE 810 571 A1 5/1974
CH 314 820 A 6/1956

(Continued)

OTHER PUBLICATIONS

European Search Report and Opinion in European Application No. EP 14 00 429 dated May 12, 2015 (4 pages).

*Primary Examiner* — Chun Cheung
(74) *Attorney, Agent, or Firm* — Shlesinger, Arkwright & Garvey LLP

(57) ABSTRACT

Container for drinking glasses includes a foot, in particular for sparkling wine glasses, and a base body. The base body includes a bottom and first and second side walls extending substantially perpendicular to the bottom, retaining means for retaining the feet of the drinking glasses is associated with at least one side wall, and the retaining means is embodied and arranged such that in a transport position the drinking glasses are supported by the bottom and extend in a direction substantially perpendicular to the longitudinal direction of the container, and the bottom includes at least (Continued)

one folding line extending in the longitudinal direction of the bottom and the bottom is foldable along the at least one folding line such that in a presentation position the drinking glasses have a substantially upright position and are supported by the side walls.

12 Claims, 5 Drawing Sheets

(56) References Cited

U.S. PATENT DOCUMENTS 5,884,767 A * 3/1999 Peng ..... B65D 5/5253
206/320

FOREIGN PATENT DOCUMENTS

| | | |
|---|---|---|
| DE | 77 11 281 U1 | 12/1984 |
| NL | 8 301 129 A | 10/1984 |

* cited by examiner

FIG. 4
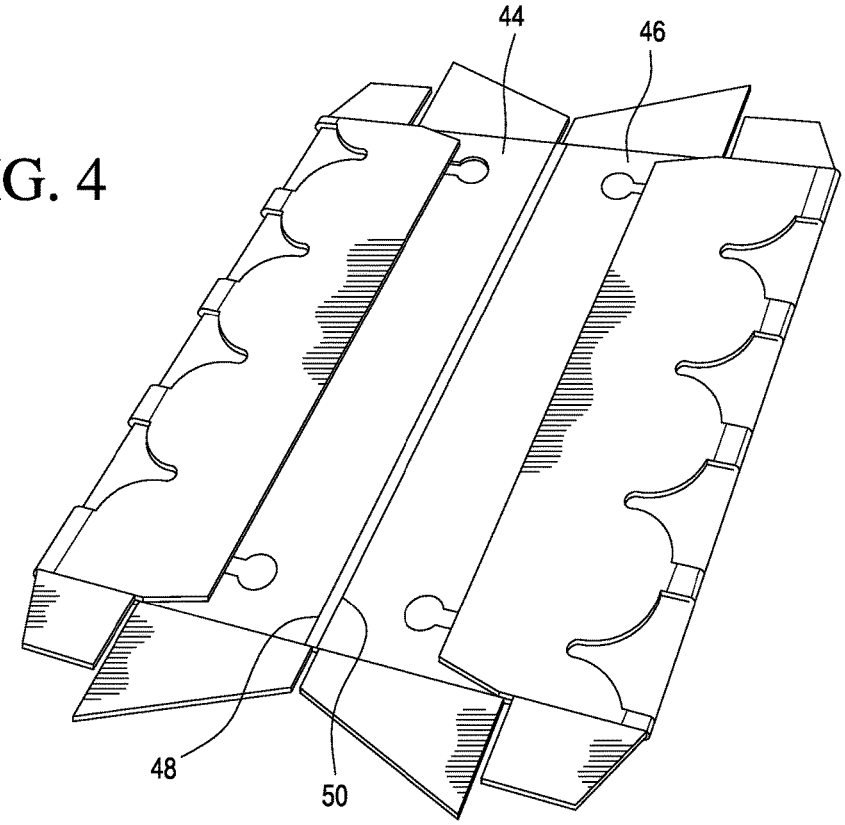
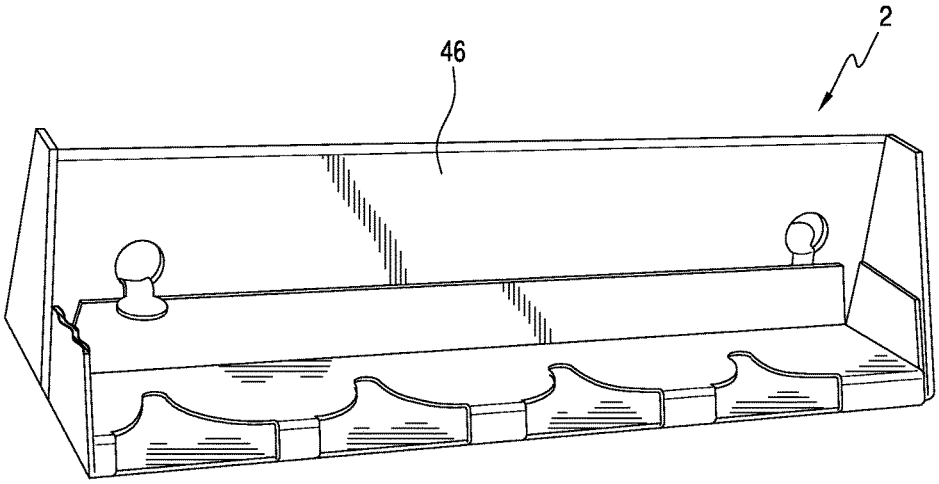
FIG. 5

CONTAINER

CROSS-REFERENCE TO RELATED APPLICATIONS

This application claims the priority of German Patent Application No. 20 2013 105 890.4, filed Dec. 20, 2013, and which is incorporated herein by reference.

FIELD OF THE INVENTION

The present invention relates to a container for a plurality of drinking glasses having feet, in particular for sparkling wine glasses.

BACKGROUND OF THE INVENTION

Containers of this kind are used in order to provide a bundle of drinking glasses for catering purposes, e.g. on board aircrafts.

OBJECTS AND SUMMARY OF THE INVENTION

It is an object of the invention to provide a container for a plurality of drinking glasses of the type having a foot which provides a secure transport as well as for a presentation of the drinking glasses for catering purposes, e.g. on board aircrafts.

This object is achieved by the invention set forth herein.

It is a basic idea of the invention to embody the container such that it may be transformed from a transport container into a presentation container. Based on this, the invention is based on the further idea to construct the container such that the drinking glasses, which in the following will also be referred to simply as glasses, in a transport position of the container are transported lying flat next to each other; while, in a presentation position the glasses are presented in an upright position so that the glasses may be filled and the filled glasses may be offered during a catering process.

According to the invention, the container includes a base body, said base body including a bottom and first and second side walls extending substantially perpendicular to the bottom, wherein retaining means for retaining the feet of the drinking glasses are associated with at least one side wall, wherein the retaining means are embodied and arranged such that in a transport position the drinking glasses are supported by the bottom and extend in a direction substantially perpendicular to the longitudinal direction of the container, wherein the bottom includes at least one folding line extending in the longitudinal direction of the bottom and wherein the bottom is foldable along the at least one folding line, such that in a presentation position the drinking glasses have a substantial upright position and are supported by the side walls.

When the container is folded along the folding line or the folding lines converting the container from the transport position into the presentation position, the glasses are brought from a lying position into a standing position, in which they may be filled. Since in the presentation position of the container the glasses are standing on the side walls or at least one of the side walls, in its presentation position the container also has the function of a tray.

Thereby, the invention presents a container which has a simple and cost-effective structure and simultaneously has a high degree of functionality.

It is a further advantage of the invention that the use of drinking glasses, for example sparkling wine glasses, for catering purposes is simplified to a substiantial degree. Wherein with containers known from the prior art, it is necessary to pick single drinking glasses out of its container and place them on a tray, according to the invention the glasses are automatically brought to an upright position, when the container is folded from its transport position into its presentation position. Therefore, the preparation of the glasses for a later filling and thereby the complete catering process is simplified and economical to a high degree.

Since in the transport position of the container the glasses are lying flat on the bottom, it is advantageous if the container is embodied and arranged such that it is stackable in its transport position. For example, a bundle including a container according to the invention and a plurality of glasses may be provided with a foil or the like, in order to prevent the glasses from falling out of the container during handling of the container. A plurality of containers according to the invention may then be stacked. Therefore, storage as well as transport of the container according to the invention is space-saving. This is the more important, if a container according to the invention is used on board aircrafts, where the storage space is very restricted.

According to a further embodiment of the invention, the retaining means are embodied and arranged such that drinking glasses which, seen, in the longitudinal direction of the container, are adjacent to each other, are alternately supported by the first and second side walls. In this embodiment, drinking glasses, which, seen in the longitudinal direction of the container, are adjacent to each other, are alternately supported by the first and second side walls, such, that after folding the container into the presentation position two parallel rows glasses are constituted. This embodiment is even more space-saving since a relatively large number of drinking glasses may be placed on a relatively small surface. Furthermore, the presentation of the drinking glasses in form of two parallel rows is aesthetically pleasing.

The retaining means associated with the side walls may be embodied in any suitable manner, for example may be formed by separate parts connected with the side walls. In order to render the construction particularly easy and cost-effective to manufacture, according to a further embodiment, the retaining means are integral with at least one side wall.

According to another embodiment, at least one side wall is embodied as a double wall including two single walls, wherein a space defined between the single walls is embodied and arranged for receiving the feet of the drinking glasses. In this embodiment, the feet of the drinking glasses are retained between the single walls of the double wall so that the retaining means are integral with the side walls in a simple manner.

According to a further embodiment, the side walls are connected by webs which extend substantially parrallel to the bottom, wherein between two webs respectively, an opening for inserting the foot of a drinking glass is defined.

According to a further development of the embodiment with the double wall in the transport position of the container a single wall facing the opposing side wall includes a cut-out for receiving the stem or shaft of a respective drinking glass. In this embodiment, the foot of the drinking glass is inserted into the opening defined between the webs, wherein the shaft of the drinking glass is guided in the cut-out. Thereby, inserting the drinking glasses is substantially simplified. According to a further embodiment, the clearance of the cut-out decreases towards the bottom, wherein the clearance of the cut-out is chosen such that the shaft of the drinking glass at least sectionally is contained in the cut-out in a substantially form-locking manner. In this embodiment, the cross-section of the cut-out decreases towards the bottom such that the shaft of a drinking glass may be inserted and moved towards the bottom into a transport position, in which the shaft of the drinking glasses is retained in the cut-out at least sectionally in a substantially form-locking manner; that is, a section of the shaft is retained in a substantially form-locking manner.

Within the terms of the invention and in the context of the invention, a form-lock means that the drinking glass is fixed such that unintended movement of the glass is avoided.

According to a further embodiment, the clearance between the single walls is chosen such that a foot of a drinking glass received in the space between the single wall is held in a clamping and/or friction-locking manner. In this embodiment, the drinking glasses are securely fixed to the container, however, may be taken out of the container in a very simple manner, when the container is in its presentation position.

In particular, the container may be made from cardboard, wherein the clearance between the single walls is chosen somewhat smaller than the thickness of the foot of a drinking glass such that the foot of the container elastically deforms the material of the side wall and is securely retained between the single walls.

According to a further development of the before-mentioned embodiment, the clearance of the space defined by the single walls, decreases towards the bottom. In this embodiment, the clearance of the space is relatively large at its end facing away from the bottom, while at its end facing the bottom, it is relatively small. In this manner, the foot of the drinking glass may be inserted into the space in a simple manner wherein the foot is retained in a clamping of friction-locking manner when it is moved into the space. According to a further embodiment, fixing means for fixing the base body in its presentation position are provided. In this manner, it is made sure that after folding the container into its presentation position, the container remains in the same.

The shape, size and construction of the container according to the invention may be chosen according to the respective requirements within wide ranges. This particularly applies to the number of drinking glasses, which are retained on the container. Furthermore, the material of the container may be chosen according to the respective requirements within wide ranges. Insofar, a further embodiment provides that the container is manufactured from cardboard, in particular from a cardboard blank. In this embodiment, the container according to the invention may be manufactured in a relatively simple and cost-effective manner. It is a further advantage of this embodiment, that a container manufactured from cardboard may be recycled after use, so that environmental impact is minimized.

In the following, the invention will be explained in greater detail referring to the enclosed drawing, in which embodiments of a container according to the invention are shown. All features which are described, shown in the drawing and claimed in the claims, constitute the subject matter of the invention, either taken alone or in arbitrary combination with each other, independently from their combination in the claims and the references of the claims as well as independently from their description or representation in the drawings.

Relative terms, such as left, right, up, and down are for convenience only and are not intended to be limiting.

BRIEF DESCRIPTION OF THE DRAWINGS

In the drawings:

FIG. 4 shows a perspective view of a base body of a slightly modified embodiment of a container according to the invention;

FIG. 5 shows the container according to FIG. 4 in its presentation position, wherein for explanation purposes the drinking glasses are omitted;

DETAILED DESCRIPTION OF THE INVENTION

Figure 1:
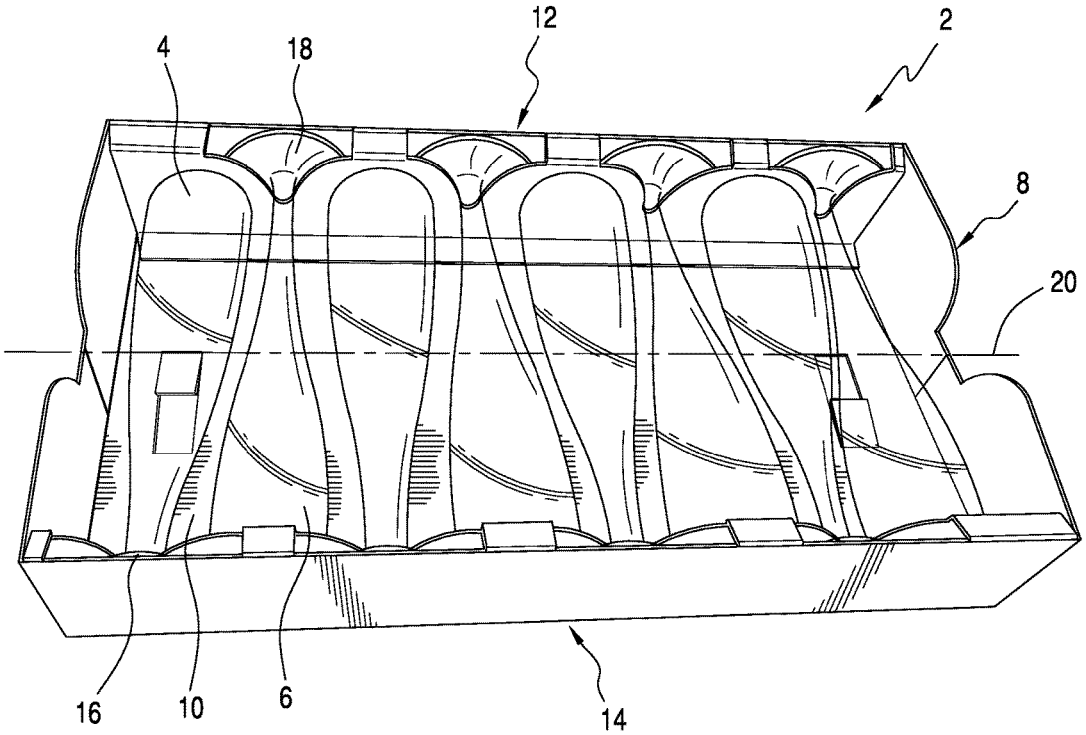
FIG. 1 shows a perspective view of a first embodiment of a container according to the invention in its transport position.
Figure 2:
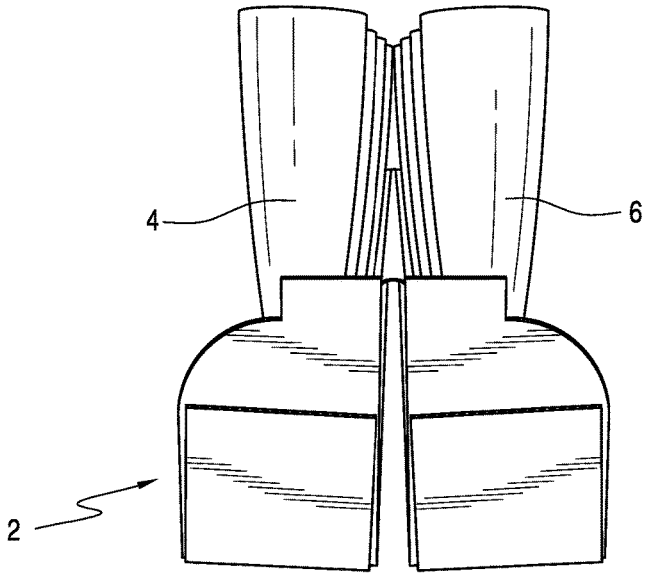
FIG. 2 shows the container according to FIG. 1 in a slightly perspective side view in its presentation position.
Figure 3:
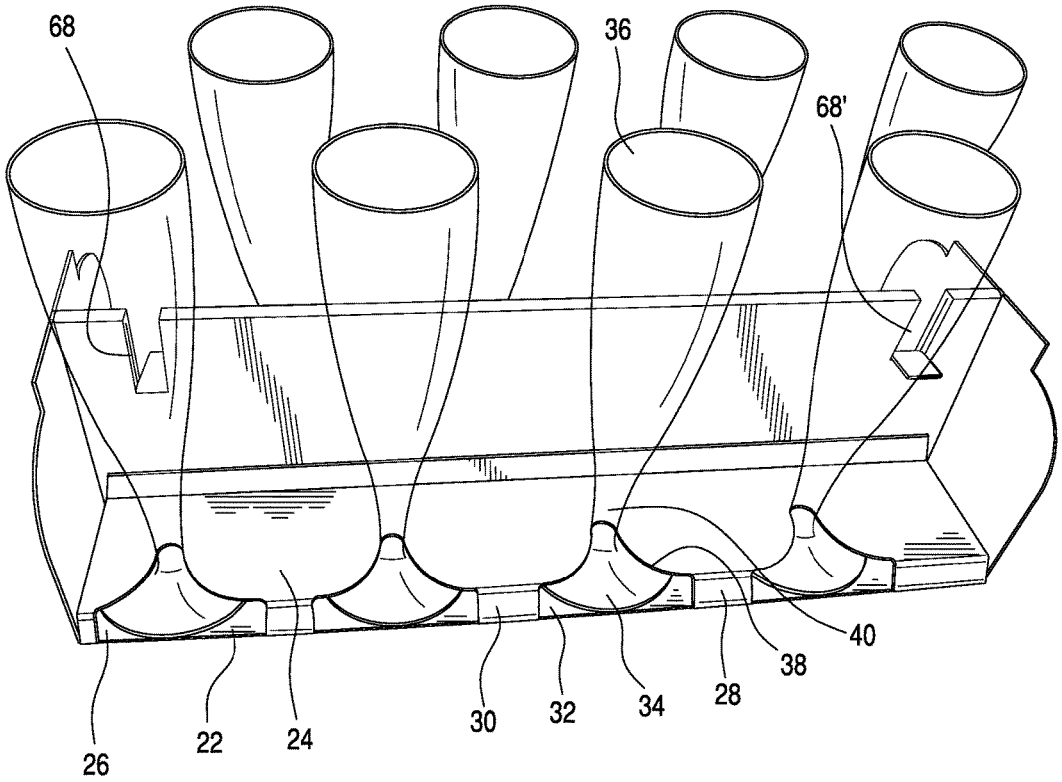
FIG. 3 shows the container according to FIG. 1 in a perspective view from above in its presentation position.

FIGS. 1 to 3 show a first embodiment of a container according to the invention, wherein FIGS. 4 to 7 show a second embodiment which in comparison to the first embodiment is slightly modified, in particular with respect to fixing means which will be explained below and are used for fixing the container in its presentation position. With respect to the essential features, both embodiments coincide.

FIG. 1 shows a first embodiment of a container 2 according to the invention for a plurality of drinking glasses including a foot, wherein in this embodiment the drinking glasses are sparkling wine glasses. In other words, for drinking glasses of the type having a bowl, a stem, and a foot connected to the bowl by the stem. For simplification purposes, in FIG. 1 only two drinking glasses are referred by reference numbers 4, 6. The container 2 includes a base body 8, said base body including a bottom 10 and first and second side walls 12, 14 extending substantially perpendicular to the bottom 10.

According to the invention, retaining means for retaining the feet 16, 18 of the drinking glasses 4, 6 are associated with the side walls 12, 14. In this embodiment, retaining means are associated with both side walls 12, 14. The retaining means are embodied and arranged such that in a transport position shown in FIG. 1 the drinking glasses 4, 6 are lying on the bottom 10 of the container 2 and are oriented substantially perpendicular to the longitudinal direction of the container 2 symbolized by a dotted line 20 in FIG. 1.

According to the invention, the bottom 10 is foldable along a folding line which extends in the longitudinal direction 20 of the bottom 10 such that in a presentation position of the container 2 the drinking glasses 4, 6 are standing on the side walls 12, 14 in a substantially upright position.

FIG. 2 shows the container 2 in its presentation position in which the drinking glasses 4, 6 are in a substantially upright position so that the drinking glasses 4, 6 may be filled and presented for catering purposes.

FIG. 3 shows another perspective view of the container 2 in its presentation position.

As shown in FIG. 1, in this embodiment the retaining means are embodied and arranged such that drinking glasses which, seen in the longitudinal direction of the container 10, are adjacent to each other, are alternately supported by the first and second side walls 12, 14. As can be taken from FIG. 3, according to the invention at least one side wall is embodied as a double wall including two single side walls, wherein a space defined between the single walls is embodied and arranged for receiving the feet of the drinking glasses. In the following, only the second side wall 14 is explained in greater detail. The first side wall 12 is embodied in the same manner and therefore will not be explained in detail.

The second side wall 14 includes two single walls or respective first and second single walls 22, 24, wherein a space 26 is defined between the single walls 22, 24, said space 26 being embodied and arranged for receiving the feet 16, 18 of the drinking glasses 4, 6. The single walls or first and second single walls 22, 24 are connected by webs, which are substantially parallel to the bottom 10, wherein in FIG. 3 only two webs are referenced by reference numbers 28, 30. Between two first and second webs 28, 30 respectively an opening for inserting a foot of a drinking glass 36 is defined. In other words, as may be readily appreciated, a first web and a second web 28, 30 are provided between and connecting the first single wall 22 and the second single wall 24, and the first and second webs 28, 30 are spaced apart in the longitudinal direction 20 of the bottom 10 and define an opening 32 for receiving the respective feet of the drinking glasses.

The side wall 24, which in the transport position of the container 2 faces the first side wall 12 includes a cut-out 38 for each drinking glass for inserting a shaft or stem 40 of a drinking glass 36. As shown in FIG. 3, the clearance of the cut-out 38 decreases towards the bottom 10, wherein the clearance of the cut-out 38 is chosen such that the shaft 40 of the drinking glass 36 is contained in a substantially form-locking manner.

Furthermore, in the illustrated embodiment, the space between the single walls 22, 24 is chosen such that a foot of a drinking glass 36 is held in the space between the single walls 22, 24 in a clamping and/or friction-locking manner. In the shown embodiment, the construction is such that the clearance of the space 26 defined between the single walls 22, 24 decreases towards the bottom 10.

When the container 2 is in its transport position (see FIG. 1) a drinking glass 36 is inserted such that the foot of the drinking glass 36 is inserted into the opening 32 from above, wherein the shaft 40 of the drinking glass is guided by the cut-out 38.

In a transport position of the drinking glass 36, in which the same lies on the bottom 10 (see FIG. 1), the shaft 40 is held at the end of the cut-out 38 in a substantially form-locking manner. Since the clearance of the space 26 between the side walls 22, 24 decreases towards the bottom 10, namely towards the end of the cut-out 38, the foot 34 of the drinking glass is retained in a clamping manner to a distinct degree between the single walls 22, 24.

Since the drinking glasses 4, 6, 36 and the further drinking glasses are securely retained on the side walls 12, 14 by the retaining means, the drinking glasses are brought into an upright position when the base body 8 of the container is folded, as shown in FIG. 2 and FIG. 3.

By means of the container 2 according the invention, a plurality of drinking glasses may be transported in a secure and space-saving manner. In order to fill the drinking glasses 4, 6, the same are brought into the upright position by folding the container 2 from its transport position (see FIG. 1) into its presentation position (see FIG. 3).

FIG. 4 shows the base body 8 of a second embodiment of a container 2 according to the invention.

FIG. 5 shows the container 2 in its presentation position, wherein for simplification purposes the drinking glasses are omitted in FIG. 4 and FIG. 5.

Figure 6:
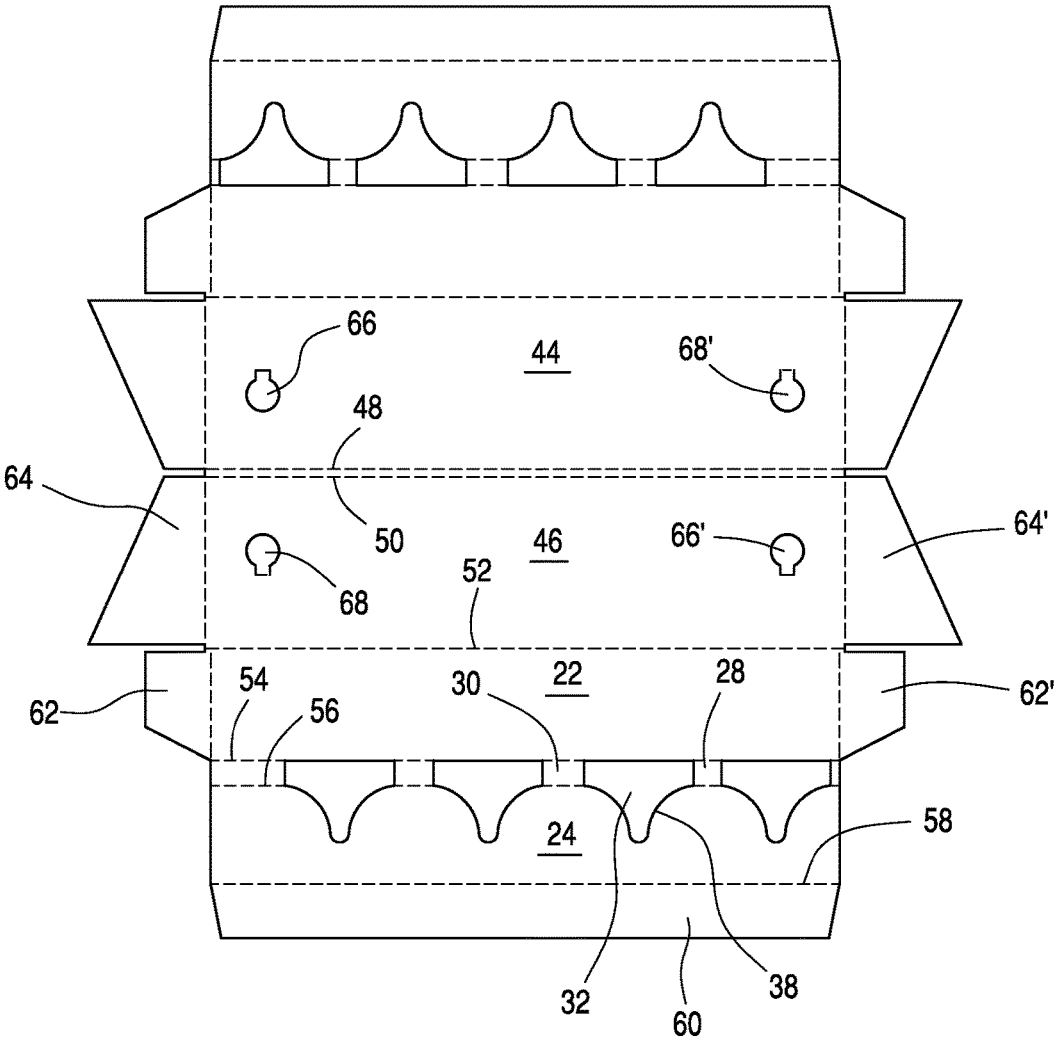
FIG. 6 shows a cardboard blank used for manufacturing the container according to FIG. 4 and FIG. 5.

FIG. 6 shows a cardboard blank for manufacturing the base body 8.

As can be seen from FIG. 4, the bottom 10 includes two bottom parts 44, 46 which are connected with each other via a folding area including two folding lines 48, 50.

For manufacturing the base body 8, the cardboard blank 42 shown in FIG. 3 is used. As can be seen from FIG. 6, the cardboard blank 42 is integral. The cardboard blank 42 includes bottom parts 44, 46, which are connected via folding lines 48, 50, and is symmetrical relative to the folding lines 48, 50. Therefore, in the following only the lower part of the cardboard blank 42 of FIG. 6 is explained in greater detail. The upper part shown in FIG. 6 is constructed in an identical manner and therefore is not explained in greater detail.

The bottom part 46 is connected with the single wall 22 via a folding line 52, the single wall 22 being connected by folding lines 54, 56 with the single wall 24. A glue tab is connected with the single wall 24 via a folding line 48. As can be seen in FIG. 6, the single wall 24 includes the cut-out 38, wherein the webs 28, 30 are located on both sides of the cut-out 38.

For manufacturing the base body 8, the glue tab is folded along the folding lines 54, 56 towards the bottom part 46 and is glued to the same, as shown in FIG. 4.

Subsequently, the side wall 14 constituted by the single walls 22, 24 is folded along the folding line 52 and is brought into a perpendicular or substantially perpendicular position with respect to the bottom part 46. In this position, the side wall 14 is glued via glue tabs 62, 62' located on the single wall 22 to glue tabs 64, 64' which are located on the bottom part 46.

In this manner, the base body 8 is constituted in its transport position, wherein for example a shaft 40 of a drinking glass 36 may be inserted into the opening 32. The same holds for further drinking glasses.

By folding the base body 8 along the folding lines 48, 50, the base body 8 is brought into its presentation position shown in FIG. 5.

Figure 7:
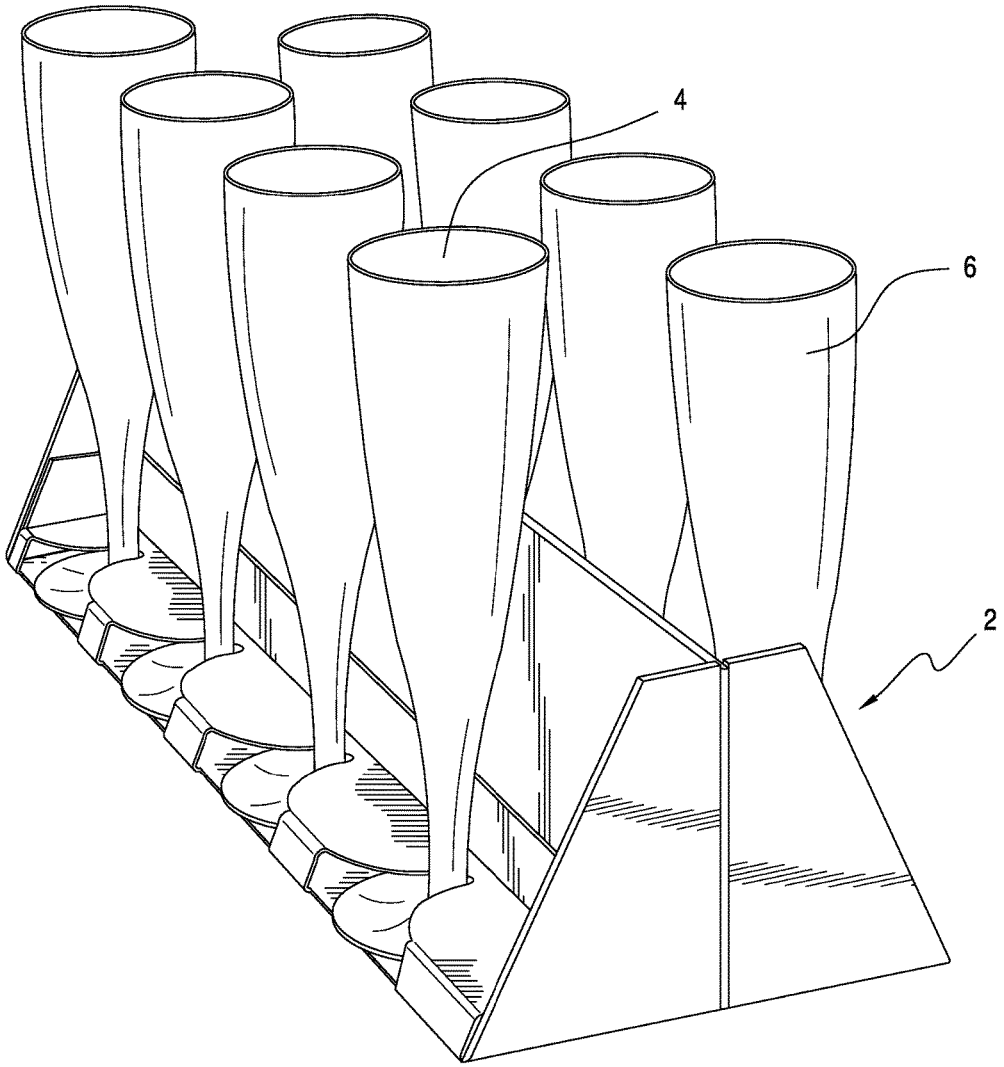
FIG. 7 shows a perspective view of the container according according to FIG. 4 in its presentation position with drinking glasses retained on the container.

FIG. 7 shows the container 2 with drinking glasses 4, 6 in its presentation position. As can be seen, for example from FIG. 7, in the presentation position the drinking glasses 4, 6 stand on the side walls 12, 14 and may be removed towards the side.

The embodiment shown in FIGS. 4 to 7 includes fixing means for fixing the base body 8 in its presentation position. For this purpose, keyhole-like flaps 66, 66' are punched out of the bottom part 44, 46. The flaps 66, 66' may be pressed into openings 68, 68' which have a substantially complementary keyhole-like form.

As can be seen in FIG. 5, in the presentation position of the container 2, the bottom parts 44, 46 are abutting against each other, so that the flap 66 substantially coincides with the opening 68 and the flap 66' coincides substantially with the opening 68'. In this position, the flap 66 may be pushed through the opening 68 towards the bottom part 46. In a similar manner, the flap 66' may be pressed into the opening 68' towards the bottom part 44, so that the container 2 is fixed in its presentation position in a secure manner. In the embodiment shown in FIG. 1 to FIG. 3, the fixing means are constituted by flaps and openings respectively, which are located in the area of the longitudinal median plane of the base body 8 in FIG. 3. The flaps are referenced by reference numerals 68 and 68' respectively.

As far as in the context of the invention, reference is made to drinking glasses, the term "glass" exclusively refers to the function of receiving drinkable liquids. The term "glass" does not refer to the material from which the drinking glasses are manufactured. Consequently, drinking glasses within the terms of the invention may be manufactured from glass or another suitable material, for example plastics.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A container for retaining, transporting, and presenting drinking glasses of the type having a bowl, a stem, and a foot connected to the bowl by the stem, the container comprising:

a) a base body, the base body including a bottom and first and second side walls extending substantially perpendicular to the bottom;

b) a retaining means provided for retaining the feet of the drinking glasses and being associated with at least one side wall, the retaining means being configured and arranged such that in a transport position the drinking glasses are supported by the bottom and extend in a direction substantially perpendicular to the longitudinal direction of the container;

c) the bottom including at least one folding line extending in the longitudinal direction of the bottom, and the bottom being foldable along the at least one folding line such that in a presentation position the drinking glasses have a substantially upright position and are supported by the side walls;

d) at least one of the first and second side walls is configured as a double wall including a first single wall and a second single wall, and a space defined between the first and second single walls is configured and arranged for receiving the feet of the drinking glasses; and e) the retaining means configured and arranged such that drinking glasses which, as seen in the longitudinal direction of the container, are adjacent to each other, and are alternately supported by the first and second side walls.

2. Container according to claim 1, wherein:

a) the retaining means are integral with at least one of the first and second side walls.

3. Container according to claim 1, wherein:

a) the first and second single walls are connected by two webs which extend substantially parallel to the bottom; and b) an opening for inserting the foot of a drinking glass is defined between the two webs, respectively.

4. Container according to claim 1, wherein:

a) in the transport position of the container one of the two single walls facing an opposing one of the first and second side walls includes a cut-out for receiving the stem of a respective drinking glass.

5. Container according to claim 4, wherein:

a) the clearance of the cut-out decreases towards the bottom, and the clearance of the cut-out is chosen such that a section of the stem of the drinking glasses is contained in the cut-out in a substantially form-locking manner.

6. Container according to claim 1, wherein:

a) clearance between the two single walls is chosen such that a foot of a drinking glass received in the space between the two single walls is held in a clamping and/or friction-locking manner.

7. Container according claim 3, wherein:

a) the clearance of the space defined by the single walls decreases towards the bottom.

8. Container according to claim 1, wherein:

a) a fixing means is provided for fixing the base body in its presentation position.

9. Container according to claim 1, wherein:

a) the container is manufactured from cardboard.

10. A container for retaining, transporting, and presenting drinking glasses of the type having a bowl, a stem, and a foot connected to the bowl by the stem, the container comprising:

a) a base body, the base body including a bottom and first and second side walls extending substantially perpendicular to the bottom;

b) a retaining means provided for retaining the feet of the drinking glasses and being associated with at least one side wall, the retaining means being configured and arranged such that in a transport position the drinking glasses are supported by the bottom and extend in a direction substantially perpendicular to the longitudinal direction of the container, and are alternately supported by the first and second retaining sidewalls;

c) the bottom including at least one folding line extending in the longitudinal direction of the bottom, and the bottom being foldable along the at least one folding line such that in a presentation position the drinking glasses have a substantially upright position and are supported by the side walls;

d) at least one of the first and second side walls is configured as a double wall including a first single wall and a second single wall, and a space defined between the first and second single walls is configured and arranged for receiving the feet of the drinking glasses; and e) a first web and a second web provided between and connecting the first single wall and the second single wall, and the first and second webs being spaced apart in the longitudinal direction of the bottom and defining an opening for receiving the respective feet of the drinking glasses.

11. Container according to claim 10, wherein:

a) in the transport position of the container one of the two single walls facing an opposing one of the first and second side walls includes a cut-out for receiving the stem of a respective drinking glass.

12. Container according to claim 10, wherein:

a) clearance between the two single walls is chosen such that a foot of a drinking glass received in the space between the two single walls is held in a clamping and/or friction-locking manner.

* * * * *